United States Patent [19]

Fletcher et al.

[11] 4,119,972

[45] Oct. 10, 1978

[54] PHASED ARRAY ANTENNA CONTROL

[76] Inventors: James C. Fletcher, Administrator of the National Aeronautics and Space Administration, with respect to an invention of; George D. Doland, Houston, Tex.

[21] Appl. No.: 765,165

[22] Filed: Feb. 3, 1977

[51] Int. Cl.[2] ..... H01Q 3/26

[52] U.S. Cl. ..... 343/844; 343/854

[58] Field of Search ..... 343/778, 854, 844

[56] References Cited

U.S. PATENT DOCUMENTS

| | | | |
|---|---|---|---|
| 3,056,961 | 10/1962 | Mitchell | 343/854 |
| 3,392,395 | 7/1968 | Hannan | 343/777 |
| 3,803,621 | 4/1974 | Britt | 343/854 |
| 3,811,129 | 5/1974 | Holst | 343/854 |
| 3,815,140 | 6/1974 | Buehler et al. | 343/840 |
| 4,052,723 | 10/1977 | Miller | 343/854 |

OTHER PUBLICATIONS

Schroeder; Technology Trends in Spacecraft Phased Arrays; Eascon 70 Convention Record; Oct. 1970.

*Primary Examiner*—Eli Lieberman

*Attorney, Agent, or Firm*—Marvin J. Marnock; John R. Manning; Marvin F. Matthews

[57] ABSTRACT

The present invention provides several new and useful improvements in steering and control of phased array antennas having a small number of elements, typically on the order of 5 to 17 elements. Among the improvements are increasing the number of beam steering positions, reducing the possibility of phase transients in signals received or transmitted with the antennas, and increasing control and testing capacity with respect to the antennas.

2 Claims, 9 Drawing Figures

A
R38
R39
R40
R36

R62
R64
R36

R36
R63

(PITCH PLANE)
Y AXIS
AZIMUTH
ANGLE
X AXIS
(ROLL PLANE)
R36

20
22
12
11
24
16
15
21
14
13

17

R11
R37
R60
R7
R10

PHASED ARRAY ANTENNA CONTROL

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 45 U.S.C. 2457).

BACKGROUND OF THE INVENTION

1. Field of Invention

The present invention relates to control of phased array antennas having a small number of elements for radiating and receiving communication signals.

2. Description of the Prior Art

Multi-element phased array antennas for radar systems having hundreds and even thousands of radiating or receiving elements have been extensively used. The technology regarding such phased-array antennas having large numbers of elements is well developed and described in available technical literature.

However, due to certain inherent size limitations in spacecraft, a need has recently arisen for phased-array antennas having a relatively small number of antenna elements, typically from 5 to 17 or so. With such a limited number of antenna elements, design concepts underlying the multi-element radar phased array antennas have to a great extent proven unfeasible.

For example, with such a limited number of elements, the number of steering angles available, as well as steering losses at these angles has often been a critical design problem. Further, steering between various beam angles caused large phase transients in communication signals passing through the antennas with a limited number of elements — a particularly important consideration when phase modulation signals were used, with phase-locked loops for tracking and synchronization.

SUMMARY OF THE INVENTION

With the present invention, it has been found that by disregarding certain of the design assumptions and concepts for prior art phased array antennas, surprising and unexpected performance improvements may be obtained.

For example, for planar phased antenna arrays with 90° steering angles theoretically available, it had been previous practice to equally space each antenna element to obtain beam steering angles over the entire theoretically available angle. With the present invention, it has been found that angles greater than a certain inherent maximum, typically on the order of 70° or so, are physically unattainable. Accordingly, this practical limit has been imposed on design of the phased array antenna with the small number of elements, and the antenna element spacing of the elements in one planar dimension of the antenna array has been made unequal to the antenna element spacing in the other planar dimension of the antenna element array. With this change, it has been found that the maximum physically achievable steering angle is achieved, while providing an increased number of beam steering positions within the achievable range of steering angles. It has also been found that this increase in the number of steering positions has the further advantage of increasing signal gain when signals are received at intermediate angles between adjacent steering angles.

Another prior art antenna beam steering technique to increase the number of steering angles was to energize only one element in the antenna array to change the steering angle by the minimum steering increment. However, with the present invention, this technique has been found to cause phase transients in signals received from an antenna with this type of steering. For any desired increment in steering angle, antenna elements located in pairs with respect to the antenna array centerpoint are controlled so that the beam is steered in increments based on steering angle changes equal in magnitude and opposite in phase between such element pairs with respect to the antenna array centerpoint, a feature which has been found to minimize phase transients in signals received from such antennas.

Also, by reducing the nominal phase increment from the conventional 45° increment, a substantial increase in the number of beam steering positions is obtained. For instance, the number of beam steering positions is more than doubled by using a nominal phase angle increment of 30° instead of the conventional 45°. This feature, coupled with the increase in antenna spacing has a further and additional advantage. Typical practice has been to send on one frequency and receive on another frequency to prevent interference between communication signals. However, if the antenna spacing and steering are set to optimize one of these frequencies, reception on the other may be significantly impaired. With the present invention, due to the reduction in steering angle increments and the increase in spacing between array elements, different antenna steering angles can be specified for sending and for receiving with the phased array antenna, and the array adjusted for effective operation at these two different operating frequencies.

The present invention further provides new and improved digital control circuitry for improved operation and control of phased array antennas having relatively small numbers of antenna elements.

It is an object of the present invention to provide new and useful improvements in control and operation of phased array antennas having relatively low numbers of antenna elements.

By means of a computer simulation, the program for and results of which are included as an appendix, the performance improvements obtained by disregarding prior art design assumptions have been verified. Such program, is not, however, claimed as the novelty of the present invention.

DESCRIPTION OF THE PREFERRED EMBODIMENT

A phased-array antenna is a number of electromagnetic radiating and/or receiving elements for the transmission and/or reception of radio signals, with these elements arranged in a plane to provide steering from a line perpendicular to the array plane, termed the antenna boresight. The individual radiating and/or receiving elements could be designed to operate primarily in the direction of the antenna boresight, and were in the past typically steered in multi-element phased array antennas having hundreds or more elements.

Due to inherent size limitations in spacecraft, these multi-element phased array antennas have not proved feasible. Rather, phased array antennas having a relatively small number of elements are needed. As used in the description of the present invention, the phrase "relatively small number of elements" should be construed to mean from five elements to seventeen or more elements, up to twenty or twenty-five.

With the present invention, it has been found that if certain conventional design assumptions are disregarded, suprising and unexpected performance results of small element number phased array antennas are achieved. By choosing the antenna parameters, it is possible to restrict the area covered by the antenna so that the field strength or antenna gain is made more uniform over this beam steering range while also minimizing phase transients as the beam is steered.

Figures 1, 2, 3, 6A, 6B, 6C, 7:
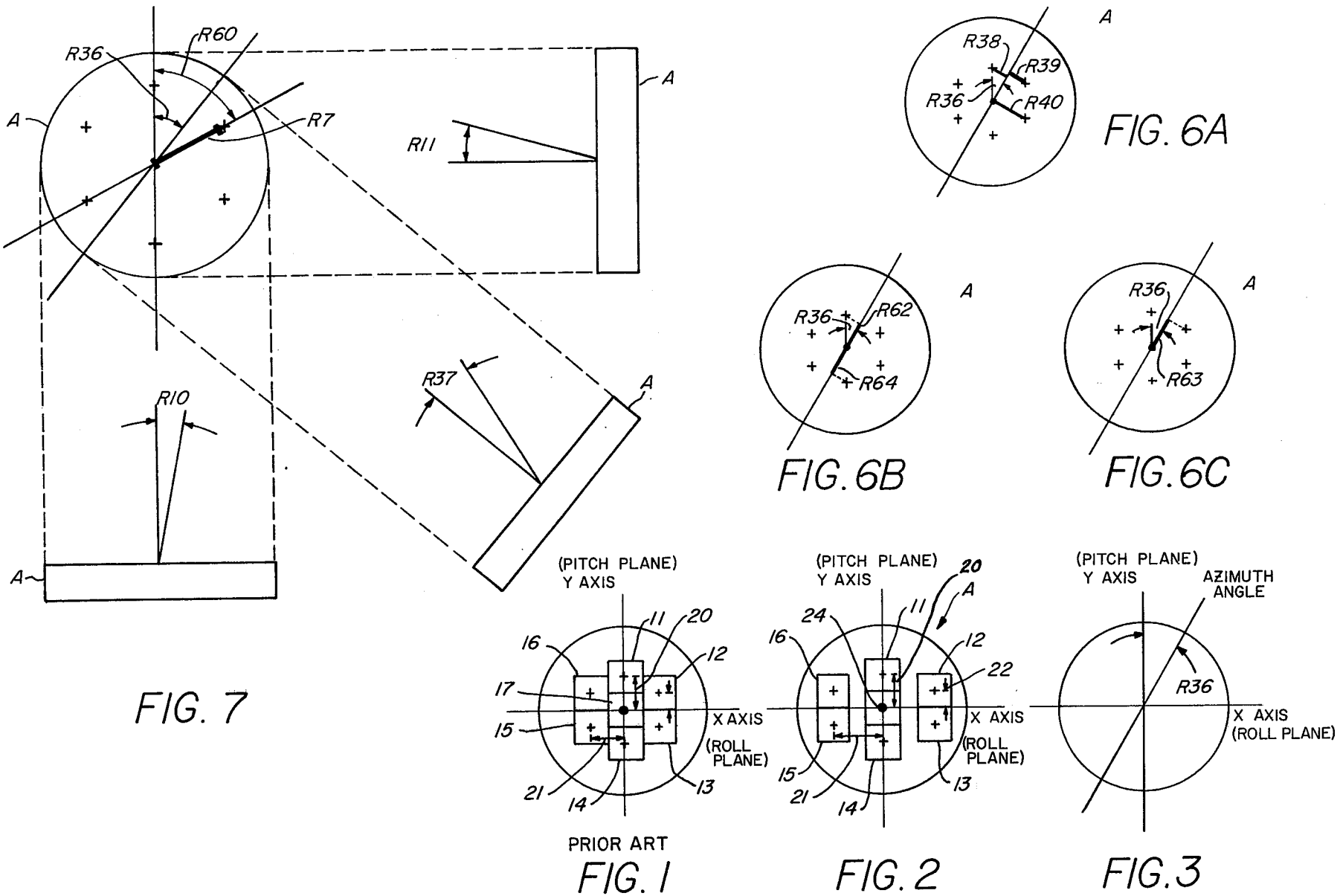
PRIOR ART FIG. 1
FIG. 1 is a schematic diagram of a seven element phased array antenna arranged according to the prior art.
FIG. 2 is a schematic diagram of a seven element phased array antenna according to the present invention.
FIG. 3 is a diagram setting forth the relation between roll axis, pitch axis and azimuth angle in phased array antenna beam steering.
FIGS. 6A, 6B, 6C, and 7 are schematic diagrams setting forth parameters useful in understanding simulations of antenna performance.

The present invention thus relates to several improvements in design of phased array antennas having a relatively small number of elements and beam steering control circuits for these phased array antennas. Referring now to FIG. 1, an antenna A having seven elements is shown in schematic form. The seven elements are conventional and are numbered 11, 12, 13, 14, 15, 16 and 17. Spacing of these elements of the antenna is based upon a basic dimension X which is the element to element spacing, typically on the order of one-half wavelength at the frequency of interest. In FIG. 1, dimension 20 and dimension 21, representing element to element spacing in the pitch plane and roll plane, respectively, are equal to X, representing nominal spacing values using prior art design philosophy for phased array antennas with few elements.

With these typical values, it is theoretically possible to steer the beam 90° from boresight at any azimuth angle. However, with the present invention, it has been found that practical limitations resulting from the antenna structure and the element pattern make it undesirable to steer the beam beyond some specified limit based on the element size and other factors, usually between 50° and 70°. Further, it has been determined that the performance of the antenna for large beam steering angles can be improved if dimensions 20 and 21 are greater than one-half wavelength. Accordingly, in FIG. 2, the dimension 21 for elements 12, 13, 15 and 16 in the roll plane is made larger than one-half wavelength, as shown, which will of necessity limit the beam steering angle to less than 90° in the roll plane.

Thus, as a first improvement in the phased array antenna design according to the present invention, it has been found that it is desirable to select antenna element spacing so as to limit the beam steering angles to those within the limitations resulting from antenna structure and accordingly provide the required beam steering range but not more than that required. This has been found to result in minimum beam steering losses at the maximum beam steering angles while also providing more optimum use of the beam steering angle increments with digitally controlled beam steering. By means of a computer program to be discussed below, an antenna designer is enabled to determine the optimum element to element distances to achieve the specified beam steering range for a particular number of antenna elements. This program further permits determination of the exact parameters to be used for specified roll and pitch angle limits.

In a typical antenna, the distance or dimension X may be, for example, 0.53 wavelength at the frequency of operation of the antenna A. According to the present invention, a parameter Y representing the ratio of the distance 20 to the distance X is set at a value of one, making the distance 20 equal to 0.53 wavelength. Because the dimension 20 is greater than one-half wavelength, the beam steering will be limited to about ±70° in the pitch plane. Further according to the present invention, a parameter Z representing the ratio of the distance 20 to the distance X is set at a value of one plus a fraction, in the range from 1.05 to 1.25, such 1-1/10, 1⅛, 1¼ or the like. With a value of 1.25 for Z and X equal to 0.53, the roll angle beam steering is limited to about ±50°.

Thus, by disregarding those beam steering angles which are physically unattainable and imposing this practical limit on design of the phased array antenna with the small number of elements, an increased number of more closely spaced beam steering positions is available. Further, when the antenna element spacing of the elements in one planar dimension of the antenna array is made a greater than unity fractional multiple of the antenna element spacing of the conventional half-wavelength spacing, which also serves as the other planar dimension of the antenna element array, still more beam steering positions within the achievable limit are available. With this change, it has been found that the maximum physically achieveable steering angle is still obtained, while also providing an increased number of beam steering positions within the achieveable range of steering angles. It has also been found that this increase in the number of steering positions has the further advantage of increasing signal gain when signals are received at intermediate angles between adjacent steering angles, since the antenna gain lobes are more closely spaced due to the increased number of steering positions.

Limiting the beam steering range to the maximum required by the specifications and not more, provides optimum utilization of the available beam steering positions. For beam steering control with phase increments of 45°, there are only four beam steering positions in the roll plane on each side of the boresight. For an antenna design using a beam steering roll angle limit of ±50° a beam steering step of about 15 degrees from 35° to 50° with no phase transient is obtained. Without an antenna design with a limit at ±50°, one of the steering steps could not be used and the beam steering step at the last usable angle would be from about 30° to about 50°. This twenty degree step is much larger than desired because of the beam directivity and loss of power at a position about 40° from boresight in the roll plane.

The advantage of the additional useful beam steering positions with an antenna designed for optimum operation in the specified steering range is even more significant for azimuth angles (FIG. 3) not in the roll or pitch planes. Using previous design considerations, all angles desired could not be obtained with a limited number of beam steering positions controlled by the size of the phase increment chosen to be equal over a 90° segment.

Another prevalent consideration was that to obtain the maximum number of beam steering positions with a specified phase increment, each antenna element should be individually controlled. However, with the present invention, it has been found that when one antenna element phase is changed, there is a change in phase of the received signal from the antenna resulting in a phase transient in the signal. In some applications, phase transients may not cause a problem. However, for phase-locked receivers, phase transients may cause a loss of phase lock and consequently may cause unacceptable performance.

With the present invention, phase transients are avoided when beam steering is accomplished using pairs of antenna elements equally distant from a center point 24 (FIG. 2) of the antenna A with equal phase angles but opposite sign when phase increments are imposed for beam steering purposes. This reduces the number of beam steering positions by two but insures that there will be no phase transients in signals passing through the antenna.

For example, if it were desired to steer the beam of the antenna A one phase angle increment about the roll axis, antenna elements 11 and 14 are each phase shifted one phase angle increment, with the polarity of these phase angle increments being opposite. In this manner, the quadrature components imposed on signals passing through the antenna A steered to this position will cancel, leaving only in-phase components and accordingly cancelling phase transients in the signal.

Thus, this technique of the present invention has been found to substantially eliminate phase transients in signals received from an antenna with this type of steering. Thus, for any desired increment in steering angle, antenna elements located in pairs with respect to the antenna array centerpoint are controlled so that the beam is steered in increments based on steering angle changes equal in magnitude and opposite in phase between such element pairs with respect to the antenna array centerpoint.

Figure 4:
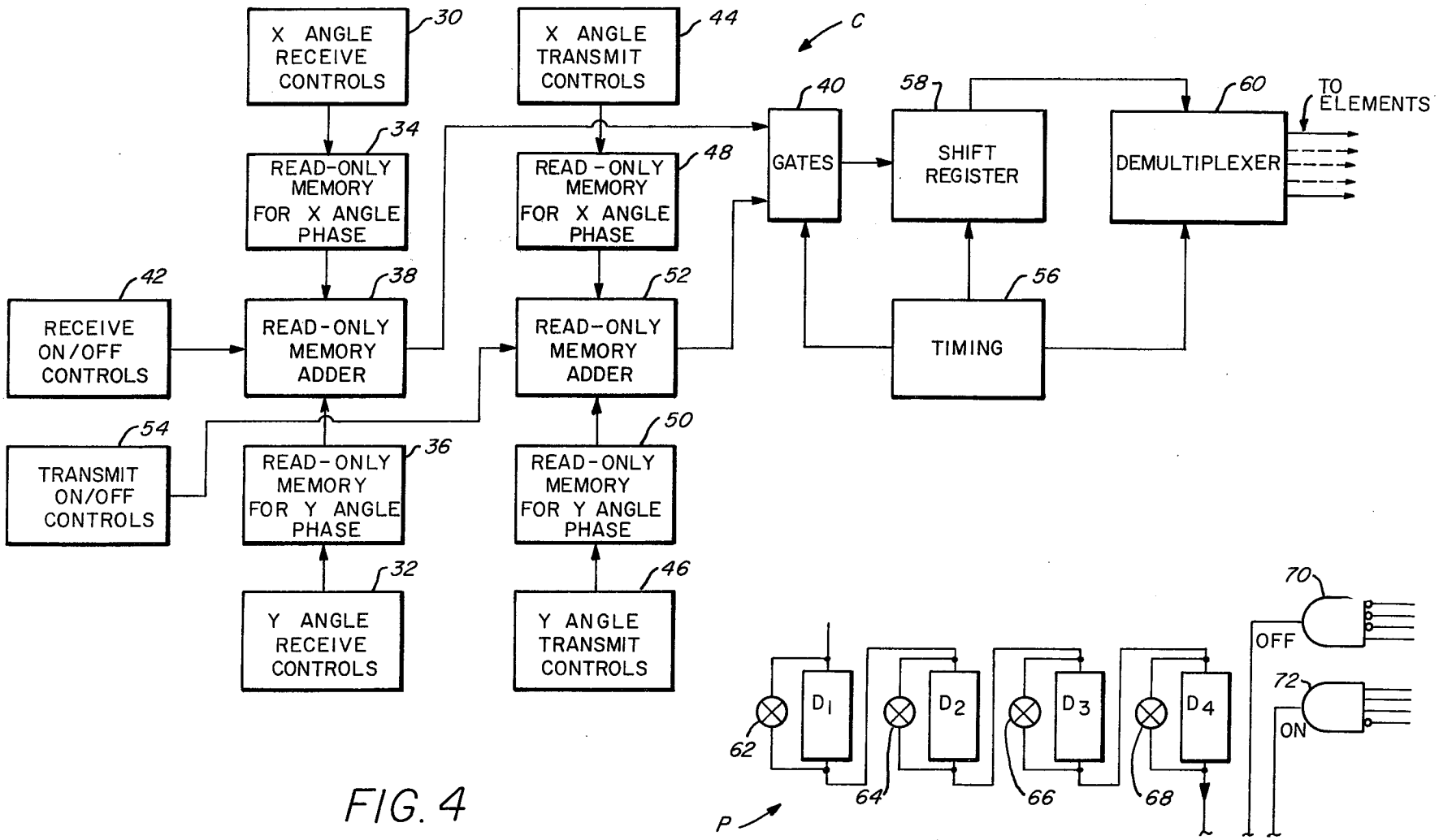
FIGS. 4 and 5 are schematic digital logic diagrams of control circuitry of the present invention.

Considering now a control circuit C (FIG. 4) for the antenna A, an X angle receive control circuit 30, which may be either a push-button input circuit or computer controlled input switches, provides input signals in the form of a digital code representing the desired angle of steering in the X plane in order to receive signals through the antenna A. Similarly, a Y angle receive control circuit 32 provides input signals representing the desired steering angle in the pitch plane or along the Y axis (FIG. 3) for receiving signals through the antenna A. The control circuits 30 and 32 provide digital codes which are storage addresses or locations in read only memory (ROM) circuits 34 and 36, respectively.

The read only memory circuits 34 and 36 respond to the digital code addresses presented thereto and select, from a particular memory location represented by the codes, a particular bit combination setting forth sequentially by element in the antenna A the desired phase delay to be imposed on such element in order to achieve the desired X and Y steering angle of the antenna A. The code output from the memories 34 and 36 are summed in a transmit read only memory adder circuit 38, a conventional digital adder, and provided to a sequencing control gate circuit 40. A receive on/off control circuit 42, of suitable input switches, either push-button or computer controlled, provides on/off control signals through the adder 38 to the gates 40 when it is desired to turn the antenna A either on or off for receiving purposes.

An X angle transmit control input circuit 44 and an Y angle transmit input control circuit 46 provide input signals, in a like manner to the input circuits 30 and 32, to read only memory storage addresses 48 and 50, respectively. The signals from input control circuits 44 and 46 represent the digital code address for the digital control numbers for the required phase delay of the elements of the antenna A for the beam to be steered to achieve the desired X and Y angles for transmitting signals through the antenna A. A digital adder circuit 52 sums the digital codes provided thereto from the memories 48 and 50 to form a code word specifying the desired phase delay to be imposed in phase angle increments on the individual elements of the antenna A in order to achieve the desired beam steering position for transmitting signals through the antenna A. A transmit on/off control circuit 54, in a like manner to the receive control circuit 42, provides signals through the adder 52 to the gates 40 to cause the individual elements of the antenna A to be energized or de-energized for transmission purposes.

The gating circuit 40 is a conventional time-controlled digital gating circuit operating under control of a timing circuit 56 to alternately provide from the adders 38 and 52 the digital control signals received from the read only memory units associated therewith. The gating circuit 40 provides the signals it receives in a sequential manner to the individual elements of the antenna A to control such elements and impose the necessary phase delay to achieve the desired beam steering position of the antenna A.

The gating circuit 40 under the control of the timing circuit 56 alternately reads from the adder 38 and the adder 52, so that each element in the antenna A receives in a time division multiplex sequence the particular control signals necessary for transmission and reception. The signals gated through the gating circuit 40 are provided into a shift register 58 and stored therein in response to control signals from the timing circuit 56. The signals stored in the shift register 58 are then read out under control of the timing circuit 56 and provided to a demultiplexing circuit 60 which routes the control signals to the particular antenna elements to be controlled, according to their time-division multiplexed sequence. The demultiplexer 60 is further controlled by the timing circuit 56 to insure synchronized operation with the gate 40 and shift register 58.

Figure 5:
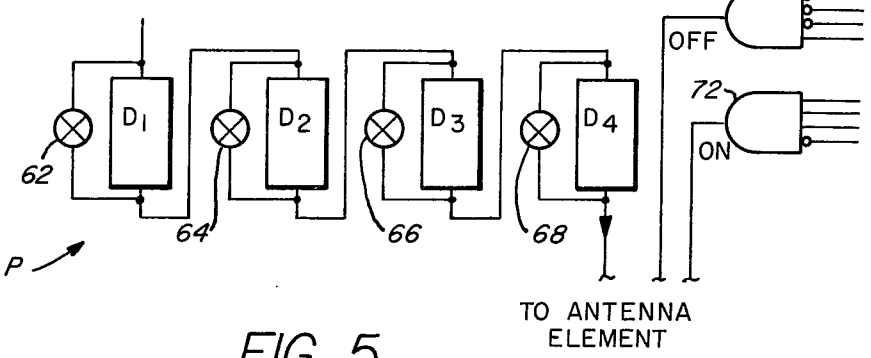

At the antenna elements, the four bit digital control word is provided to a phase shift circuit P (FIG. 5) having four delay circuits $D_1$, $D_2$, $D_3$ and $D_4$, each imposing a different increment of phase delay to the antenna element being controlled, in order to control the phase delay of such element and achieve the desired beam steering angle from the antenna A. The individual delay circuit $D_1$, $D_2$, $D_3$ and $D_4$ are preferably in the form of stripline hairpin loops of predetermined length for the frequencies of interest to impose the requisite phase angle increments of delay for beam steering purposes.

The delay circuit $D_1$ responds to the least significant digital control bit from the control circuit C and imposes one phase angle increment of delay thereon. A voltage responsive digital switch 62 responds to the absence of the least significant digital control bit in the digital control word and shorts out the delay circuit $D_1$. The delay circuit $D_2$ responds to the next significant control bit, or second bit in the four bit digital control word of the digital control signal, and controls the phase angle in two phase angle increments. A voltage responsive digital switch 64 responds to the absence of the next significant control bit in the digital control signal and shorts out the delay circuit $D_2$.

A delay circuit $D_3$ responds to the next most significant control bit, or third bit, in the four bit digital control word of the digital control signal for the antenna A and controls the phase angle in four phase angle increments. In the absence of the next most significant control bit in the digital control word, a voltage responsive digital switch 66 shorts out the delay circuit $D_3$ removing the four phase angle increment delay. The delay circuit $D_4$ imposes a phase angle delay of seven phase angle increments on the antenna A in response to the most significant control bit, or fourth bit, in the digital control signal. For reasons to be set forth, the delay circuit $D_4$ responds to an opposite logic level than the remaining delay elements. Thus, in the presence of the most significant control bit, a switch 68 shorts out the delay circuit $D_4$ removing the seven phase angle increment delay.

An OFF gate 70 and an ON gate 72 respond to the appropriate coded signal in the digital control word from the control circuits 42 and 54 in order to turn the power provided to the antenna element off or on, as the case may be, in response to the presence of the energizing or de-energizing code in the digital control signal.

The conventional phased array antennas with few radiating and/or receiving elements have used phase increments of $\pi/4$ radians, or 45°, for equal phase increment spacing over the entire theoretically available steering range of 90°. Antenna element phase angle control using 45° phase increments requires three digital data bits. Another improvement of the present invention, in contrast to conventional phase increments, uses phase angle increments of less than $\pi/4$ radians, preferably $\pi/6$ radians or 30°. When the phase angle increment is reduced to 30°, four bits are required. The change from 45° to 30° increases the beam steering positions from 4 to 6, even when the antenna is designed for the optimum beam steering range. Computations, using the computer program in the Appendix, have verified that the reduction in beam steering loss is desirable for the change from 4 to 6 beam steering angles but that any additional steps are generally not significant.

With a four bit control word as the digital control signal, the control circuit C forms four bit digital control words which are used in the manner set forth above, to achieve the desired beam steering angles and also provide auxiliary functions. Alternate circuits can be used where each bit controls a segment of a delay element for phase control but specific combinations are detected and effect the auxiliary functions. The following chart indicates the improved control system of the present invention using a digital control signal of four digital bits for one antenna element.

PHASE SHIFT/CONTROL CHART

| MOST SIGNIF. BIT | NEXT MOST SIGNIF. | NEXT SIGNIF. BIT | LEAST SIGNIF. BIT | CONTROL (CODE) |
|---|---|---|---|---|
| 0 | 1 | 1 | 1 | energize element |
| 0 | 1 | 1 | 0 | +180 degrees (+6) |

-continued

PHASE SHIFT/CONTROL CHART

| MOST SIGNIF. BIT | NEXT MOST SIGNIF. | NEXT SIGNIF. BIT | LEAST SIGNIF. BIT | CONTROL (CODE) |
|---|---|---|---|---|
| 0 | 1 | 0 | 1 | +150 degrees (+5) |
| 0 | 1 | 0 | 0 | +120 degrees (+4) |
| 0 | 0 | 1 | 1 | +90 degrees (+3) |
| 0 | 0 | 1 | 0 | +60 degrees (+2) |
| 0 | 0 | 0 | 1 | +30 degrees (+1) |
| 0 | 0 | 0 | 0 | 0 degrees |
| 1 | 1 | 1 | 1 | 0 degrees |
| 1 | 1 | 1 | 0 | −30 degrees (−1) |
| 1 | 1 | 0 | 1 | −60 degrees (−2) |
| 1 | 1 | 0 | 0 | −90 degrees (−3) |
| 1 | 0 | 1 | 1 | −120 degrees (−4) |
| 1 | 0 | 1 | 0 | −150 degrees (−5) |
| 1 | 0 | 0 | 1 | −180 degrees (−6) |
| 1 | 0 | 0 | 0 | deenergize element. |

This coding chart can be seen to have the capability to turn on and off any specific element for test purposes. The capability to de-energize any single element also provides the capability to de-energize the opposite element angles. Also, failure of the control circuit C or phase shift circuit P to all logical zeros or all logical ones provides zero degrees phase which will provide boresight operation for total failure of the control circuitry C. This control system thus fails to the best limited operation.

Another feature of the present invention is to provide that the delay circuit P have delay elements of a 210° segment ($D_4$), 120° segment ($D_3$), 60° segment ($D_2$) and 30° segment ($D_1$). The most significant of the four bits thus controls the 210° segment $D_4$, the next most significant bit controls the 120° segment, the next significant bit controls the 60° segment, and the least significant bit controls the 30° segment.

Further, it is to be noted that the digital switch 68 responding to the most significant bit of the digital control signal operates inversely compared to the switches 62, 64 and 66 responding to the remaining three bits of the digital control circuit. For example, when there are all logic zeros in the digital control signal, and 210° delay segment $D_4$ is operating but the other three delay segments are shorted out by their respective switches and are bypassed. Conversely, when there are all logic ones in the digital control signal, the 210° segment is bypassed by the switch 68 but the other three which add to 210° are operating. Therefore, the reference phase of 0° in the foregoing chart is 210° lagging compared to the input of the phase control circuit P. It should be noted that the phase increments represent lagging signals. The element ON/OFF function is detected by the four input NAND or AND gate 72 or 74, as the case may be, to control the power circuit to each element, as set forth above.

When a phased array antenna is used for transmission and reception at two different frequencies, the beam steering angles are not identical, and a large beam steering for transmitting and/or receiving can be very undesirable and represent a significant impairment or loss of signal power at one of the two frequencies. Another feature of the present invention resolves this problem. The antenna array A is designed for a center frequency approximately midway between the two frequencies. At the lower frequency, the spacings between elements are proportionally less than for the center frequency while the spacings at the higher frequency are proportionally longer. Since separate phase shifting networks in the control circuit C are used for phase control of transmission and reception, beam steering to accommodate for two frequency operation at two different steering angles is provided. This arrangement provides a relay capability for the antenna A for receiving and transmitting in different directions.

The use of separate phase shifting networks also permits the delay circuits of the elements to compensate for the different frequencies to obtain the same beam steering angles for both frequencies. If the wavelength is longer and therefore there is an apparent decrease in spacing, the delay of the signal is decreased proportionally with frequency using the control circuit C. Conversely, if the wavelength is shorter, the delay of the signal is increased proportionally with frequency, so that phase angle increments which are not exactly 30° are specified, and they are chosen to be either larger or smaller, as required, to compensate for the effective change in element spacing caused by a change in frequency.

It should also be noted that the antenna A may be required to receive or transmit over a band of frequencies. A delay circuit based upon a transmission line concept automatically compensates for the effective change in spacing of the antenna elements because of the change in wavelength. Therefore, the antenna and phase control circuits are inherently compatible. There is sometimes a requirement to provide phase shift of both +180° and −180°, but because there are only eight available states due to the use of three bits and nine states are required, the current designs do not provide the required control capability. However, reference to the Table set forth above shows this problem is resolved in the present invention by using a transmission line phase control circuit with provision for obtaining phase shift at or near +180° and at or near −180° as separate as distinct phase control angles. Further, when phase increments of approximately 30° are used and there is no requirement for on/off control of each element, phase angles of approximately ± 120° are available. These phase angles can be used for beam steering to obtain additional beam steering increments.

Figure 8:
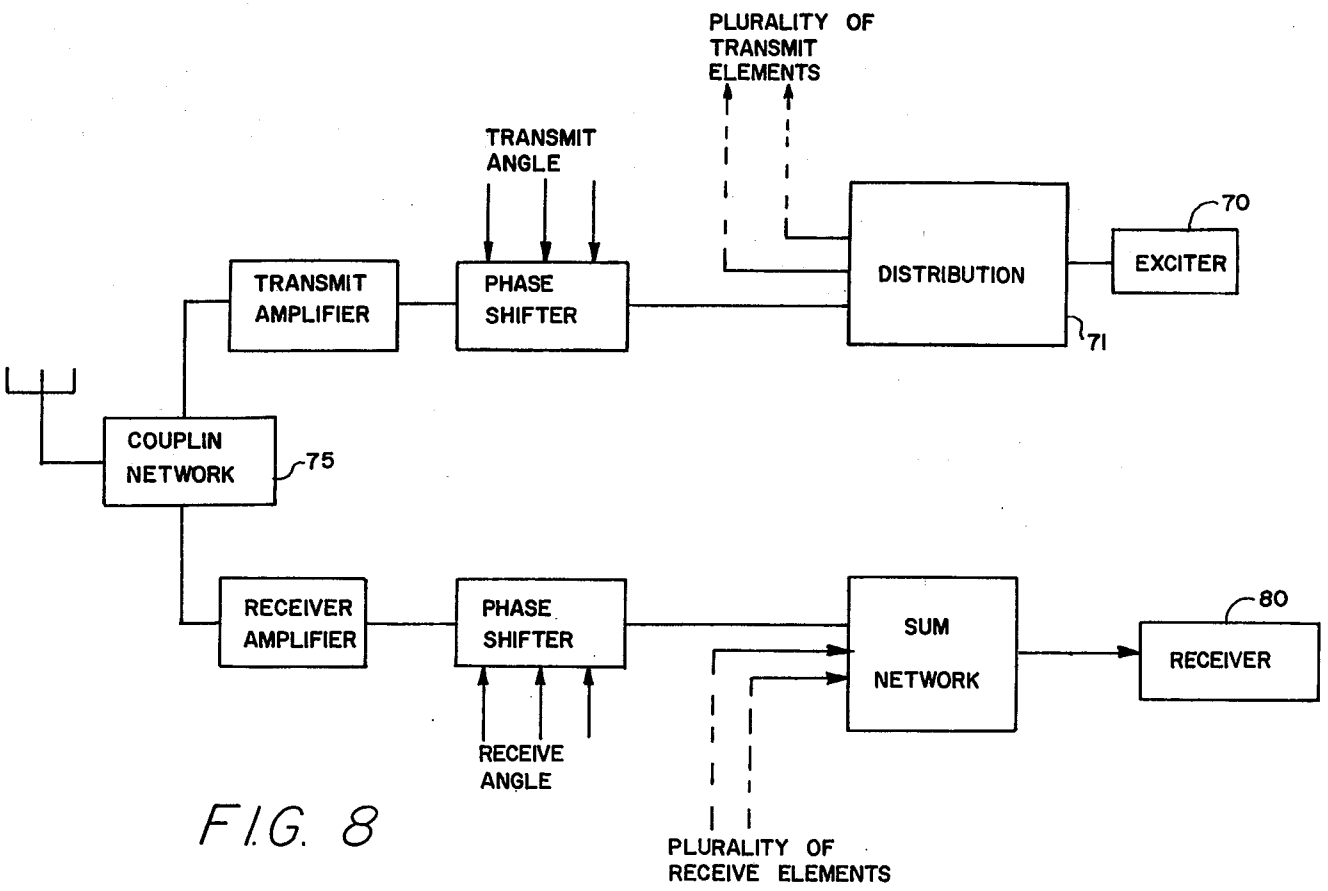
FIG. 8 is a schematic block diagram of a phased array antenna showing the coupling network for the invention.

A coupling network for the invention is shown in FIG. 8. This type of network is conventional and, as shown, can be used for transmitting and receiving. In transmission, signals pass from an exciter 70 through a distribution network 71 and to each radiating element through a phase shifter, amplifier, and coupling network 75. For communications and using two frequencies, the coupling network would typically be a diplexer. In receiving, signals from each element are delivered from the coupling network 75 to the receiver 80 through a receiver amplifier, phase shifter, and summing network. It is to be understood it is not necessary that the transmitter amplifier and receiver amplifier be used. Instead, the phase shifter for transmission and reception can be fed directly to the coupling network 75 and the antenna; or, when operation at one frequency is contemplated, a single phase shifter can be used and the network 75 for separating transmitting and receiving signals moved to the right of the phase shifter in FIG. 8.

APPENDIX

The performance improvements obtained with the present invention have been verified with a computer simulation run using a calculator program. Although a Hewlett-Packard 9820A calculator was used, other calculators, or a computer, may be used for the computations. This simulation is explained in terms of the calculator program with FIGS. 6 and 7 of the drawings to identify the variables. While a brief definition is given for the symbols, abbreviations and acronyms used, reference is made to the 9820A calculator and peripheral equipment manuals for further conventional details.

The calculator provides six letter keys for storage of information. Letter keys A, B and C are used to store values related to the antenna parameter distances 20, 21 and 22 and are shown in FIGS. 1 and 2. The three letter keys X, Y and Z, also represent parameters related to the ratios of antenna spacing to wavelength, as previously set forth. These parameters will be explicitly defined later in this disclosure.

Table I indicates the actual data stored in each storage register and references the figures for a more precise definition when required. All distances are measured in terms of wavelength of the signal using units of degrees. For example, a length of one-half wavelength will be 180°. In same cases reference must be made to the calculator program to determine the actual computations. For memory allocations R1 through R6, the entry is in phase angle increments but is converted to degrees. The original phase angle increments are retained in registers R51 through R56 respectively.

The letters and numbers in FIGS. 6 and 7 relate directly to the corresponding alphanumeric symbols required in the calculator program. Further, in FIG. 3, R36 represents the azimuth angle. In the program, R36 will refer to the azimuth angle. To solve the entire problem, data is first entered in rectangular coordinates and later converted to spherical coordinates.

Regardless of the initial selection, it is always necessary to rotate the coordinate system so that the azimuth plane of FIG. 3 passes through the center of the phased-array antenna, and the other terminal in the radio frequency link. FIG. 7 is a plan view of the phased-array antenna A, with orthographic projection based upon the azimuth plane, which is used for spherical coordinates. This figure identifies specific variables in the calculator program.

FIGS. 6A, 6B and 6C are plan views of the phased-array antenna A. Each plus sign represents the center of each radiating and/or receiving element. Line segments R62 and R64 terminate at the center. The center also represents a radiating and/or receiving element and has a reference phase of zero.

Because the trigonometric sine and cosine functions go at zero at specific angles and the tangent function may approach infinity, it is necessary to compute the roll (or X) function and the pitch (or Y) function independently in rectangular coordinates. Then the system is rotated by the azimuth angle and converted to spherical coordinates.

An interactive program is used and printing is on both the 2-inch-wide paper tape and the calculator 80-characterper-line line printer. The 2-inch paper tape printout is to verify adequate performance; the actual data to be used is printed on the line printer.

There are multiple solutions to the problem which are called grating lobes. Certain types of printouts indicate invalid data. A printout SIGNAL INVERTED indicates a grating lobe or signal other than the main lobe. Other unusual output data may include a side lobe. It is therefore necessary to perform the correct sequence of operations or insert correct initial conditions. The program uses symbols, abbreviations, and acronyms which must first be defined. Table II defines the acronyms and abbreviations; Table III shows the various symbo's used. Table IV is the program consisting of 227 lines (counting line 0).

The program is loaded into the calculator and the RUN PROGRAM key operated. The calculator will request data which is entered by the keyboard and the RUN PROGRAM key depressed. The operation of the program and printout obtained in dependent upon the mode selected. There are four modes: (1) Beam steering angle and loss, (2) Loss at Specified Angle, (3) Loss at specified angle array, and (4) Loss at specified angle with element pattern array. When mode one is selected, the program will automatically calculate the beam steering angle and beam steering loss for the antenna parameters and phase angles entered in the program. It is necessary to have an initial starting roll and pitch angle which is approximately the correct beam steering angle. These data may be obtained using the previous calculations when the beam is steered in increments of about 10° to 15°. The required data may be entered when the roll and pitch angle inputs are requested.

The second mode of operation calculates the loss at any specified roll and pitch angle for the antenna parameters entered into the program. This provision makes it possible to check the antenna pattern by sampling the signal level at various angles.

The third and fourth modes are similar. The program calculates the loss for specific roll and pitch angles and is automatically stepped in 3° increments. This provision makes it possible to determine the entire antenna pattern. In mode three, the element pattern is not included so only the beam steering loss is determined. In mode four, the element pattern is assumed to be a cosine function and the computations include the element pattern to indicate the relative amplitude referenced to the maximum theoretical power at the target at boresight.

This program makes it possible to calculate the critical antenna parameters, determine the beam steering angles in rectangular and spherical coordinates, calculate the beam steering angles, determine the beam steering loss, determine the antenna pattern including the element pattern, and calculate the phase of the signal at the target. With this program, it is practical to implement the invention and achieve the indicated improved performance provided by the disclosed improvements.

When operating the program, in mode 1, it is preferable to start at boresight. When starting at the boresight, and an off-axis entry is generated by the phasor combination, there may be an overflow condition indicated. Press the STOP key, CLEAR key, GTO key, enter 16 and press the EXECUTE key, and then the RUN PROGRAM key. The calculator will then request a roll angle; the roll angle printed on the 2-inch paper tape should be entered and the RUN PROGRAM key operated. The pitch angle should then be entered from the 2-inch paper tape and the RUN PROGRAM key again operated. The program is now in condition so there will be no overflow if suitable phasor settings are used.

In this program, the phase angles are entered in increments. The increment size is established by entering the increment size when the calculator requests PHASE INCREMENT. The phasor angles are entered as an integral number of phase increments. Positive numbers represent lagging phase angles and negative numbers leading phase angles. It is essential for proper operation of the program that the correct sign be used for angles of 180°. Although the trignometric function values are identical for +180° and −180°, angles are added in the program and the correct result is obtained only when the proper sign is used.

Table V is a printout showing roll, pitch and off-axis beam steering angles using phase increments of approximately 45°. The phase codes set forth in Table V represent the number of phase angles increments of phase shift, as described in the application, with a negative sign implying a negative phase shift, as set forth in the chart in the application. Table VI is similar. It represents the same antenna operating at a different frequency but providing the same beam steering angles for the same phasor control signals except for residual error. Considering Table V a distance of 0.51 wavelength was selected with the parameter Y value of 1.0 to obtain approximately 20° beam steering for the pitch angle. The value for the parameter was selected at 1.25 to provide about 50° of beam steering for the roll angle. Phasor values were selected for control which provides a phase angle of 0° relative to the signal for the center element. Making the antenna spacing in accordance with the principles established provides about 10° beam steering position from boresight. The last beam steering position for roll is 15° from about 35° to 50°. The last beam steering position for pitch is about 20° from about 50° to 70°.

Only phasor settings were used which provided a zero phase angle for the resultant signal with reference to the signal from the center element. This insures a zero phase transient with beam steering. Three off-axis beam steering angles are provided in the table but there are many more beam steering angles available. There will be no phase transients when each pair of elements symmetrical about the center point have equal and opposite phase angles. This is demonstrated by all phasors shown in the table. This demonstrates one feature of the present invention.

The improvement obtained by reducing phase angle increments is demonstrated by comparing Table VI and Table VII. Table VI is for phase increments near 45° while Table VII is for phase increments near 30°. It will be noted that the total beam steering range is the same for both antenna simulations but there are 1½ times as many beam steering angles for phase increments near 30° compared to the antenna with phase increments near 45°.

The great advantage for phase increments near 30° is in beam steering control for large beam steering angles and off-axis. A printout, Table VIII, provides some off-axis beam steering angles. There are three angles in the table with losses of about ½ decibel. However, also in the table are other phasor combinations which yield beam steer angles approximately 5° from that having ½ decibel loss with only about ⅛ decibel loss. There is also a beam steering angle of about 50° roll and 70° pitch with a loss of about ⅛ decibel. Therefore, the antenna can be steered to cover a rectangular area with low loss along all edges and the corners.

These tables, Table V through VIII, use a maximum of six phase increments both leading and lagging and zero which can be implemented by four bit digital control, the advantages of which have been set forth.

The improvement in broad band coverage, or two frequency operation, is demonstrated by comparison of Table V and VI. Different wavelengths or frequencies are represented by the two different antenna spacing factors represented by DISTANCE. Almost equal beam steering angles are achieved by selecting the appropriate phase angle increment of 43° or 47° to match the distance values of 0.51 and 0.55 wavelengths.

TABLE I

| MEMORY ALLOCATIONS | |
|---|---|
| A | Distance in degrees; see FIG. 2 (20) |
| B | Distance in degrees; see FIG. 2 (22) |
| C | Distance in degrees; see FIG. 2 (23) |
| X | Fraction of wavelength distance used as the basic distance |
| Y | Ratio of distances |
| Z | Ratio of distances |
| R0 | Phase increment |
| R1 | Phase angle increment for element 1 |
| R2 | Phase angle increment for element 2 |
| R3 | Phase angle increment for element 3 |
| R4 | Phase angle increment for element 4 |
| R5 | Phase angle increment for element 5 |
| R6 | Phase angle increment for element 6 |
| R7 | Distance in degrees; see FIG. 7 |
| R8 | Cosine of angle R60; see FIG. 7 |
| R9 | Sine of angle R60; see FIG. 7 |
| R10 | Roll angle; see FIG. 7 |
| R11 | Pitch angle; see FIG. 7 |
| R12 | Summation of sine functions for the boresight signal |
| R13 | Summation of cosine functions for the boresight signal |
| R14 | Phase angle of boresight signal at target |
| R15 | Iteration index count |
| R16 | Phase angle at target from element 2, for roll angle computation |
| R17 | Phase angle at target from element 3, for roll angle computation |
| R18 | Phase angle at target from element 5, for roll angle computation |
| R19 | Phase angle at target from element 6, for roll angle computation |
| R20 | Summation of the sine functions at the target |
| R21 | Summation of the cosine functions at the target |
| R22 | Residual roll angle phase error at the target |
| R23 | Phase angle at target from element 1, for pitch angle computation |
| R24 | Phase angle at target from element 2, for pitch angle computation |
| R25 | Phase angle at target from element 3, for pitch angle computation |
| R26 | Phase angle at target from element 4, for pitch angle computation |
| R27 | Phase angle at target from element 5, for pitch angle computation |
| R28 | Phase angle at target from element 6, for pitch angle computation |
| R29 | Summation of the sine functions at the target |
| R30 | Summation of the cosine functions at the target |
| R31 | Residual pitch angle error at the target |
| R32 | Magnitude or loss of the boresight signal power |
| R33 | Roll loss in decibels |
| R34 | Index count for iterations |
| R35 | Pitch loss in decibels |
| R36 | Azimuth angle in spherical coordinates; see FIGS. 3 and 7 |
| R37 | Deflection or deviation angle in spherical coordinates; see figure 7 |
| R38 | Distance in degrees; see figure 6A |
| R39 | Distance in degrees: see figure 6A |
| R40 | Distance in degrees; see figure 6A |
| R41 | Angle function for element 1 |
| R42 | Angle function for element 2 |
| R43 | Angle function for element 3 |
| R44 | Angle function for element 4 |
| R45 | Angle function for element 5 |
| R46 | Angle function for element 6 |
| R47 | Summation of sine functions |
| R48 | Summation of cosine functions |
| R49 | Coordinate conversion factor |
| R50 | Azimuth angle error at target |
| R51 | Phase angle increment for element 1 |
| R52 | Phase angle increment for element 2 |
| R53 | Phase angle increment for element 3 |
| R54 | Phase angle increment for element 4 |
| R55 | Phase angle increment for element 5 |
| R56 | Phase angle increment for element 6 |
| R57 | Roll angle for off-axis computations |
| R58 | Pitch angle for off-axis computations |
| R59 | Coordinate conversion factor |
| R60 | Angle; see figure 7 |
| R61 | Type of computation: boresight, roll, pitch or off-axis |
| R62 | Distance in degrees; see FIG. 6B |
| R63 | Distance in degrees; see FIG. 6C |
| R64 | Distance in degrees; see FIG. 6B |
| R65 | Angle function for element 1, with cosine correction |
| R66 | Angle function for element 2, with cosine correction |
| R67 | Angle function for element 3, with cosine correction |
| R68 | Angle function for element 4, with cosine correction |
| R69 | Angle function for element 5, with cosine correction |

TABLE I-continued

| MEMORY ALLOCATIONS | |
|---|---|
| R70 | Angle function for element 6, with cosine correction |
| R71 | Summation of sine functions |
| R72 | Summation of cosine functions |
| R73 | Deflection or deviation angle residual error in degrees |
| R74 | Beam steering loss in decibels |
| R75 | Circle segments |
| R76 | Signal power for roll computations |
| R77 | Signal power for pitch computations |
| R78 | Signal power for off-axis computations |
| R79 | Indexing factor |
| R80 | Cosine of R37 |
| R81 | Sine of R37 |
| R82 | Sine of R36 |
| R83 | Mode |
| R84 | Coordinate conversion factor |
| R85 | Coordinate conversion factor |
| R86 | Half-circle segment |
| R87 | Phase angle for element 1 at target |
| R88 | Phase angle for element 2 at target |
| R89 | Phase angle for element 3 at target |
| R90 | Phase angle for element 4 at target |
| R91 | Phase angle for element 5 at target |
| R92 | Phase angle for element 6 at target |
| R93 | Summation of cosine functions representing signal power |
| R94 | Date code |
| R95 | Phase angle at target |
| R96 | Sine functioon, see line 99 in the program |
| R97 | Sine function, see line 99 in the program |
| R98 | Sine function for phase angle (R95) computation |
| R99 | Cosine function for phase angle computation |
| R100 | Trignometric function (temporary storage) |
| R101 | Trignometric function (temporary storage) |
| R102 | Trignometric function (temporary storage) |
| R103 | Trignometric function (temporary storage) |

TABLE II

| ACRONYMS USED IN PROGRAM | |
|---|---|
| ABS | Absolute value |
| ATN | Trigonometric arc tangent function |
| COS | Trigonometric cosine function |
| DB | Decibel |
| E | Exponent to base 10 |
| END | End of program |
| ENT | Enter data from keyboard |
| FMT | Format statement |
| FXD | Fixed decimal point numerical data |
| GSB | Go to subprogram |
| GTO | Go to statement number indicated, or advance or go back the number of steps indicated |
| IF | If the following expression is true, complete the line; if not true, go to the next line |
| LOG | Common logarithm |
| PRT | Print on 2-inch-wide paper tape |
| RET | Return to main program from a subprogram |
| SIN | Trigonometric sine function |
| SPC | On the 2-inch paper tape printer advance 1 or more lines |
| SUB1 | Subprogram 1 |
| SUB2 | Subprogram 2 |
| SQR | Square root function |
| TAN | Trigonometric tangent function |
| TO | Enter data in register indicated |
| WRT | Print on the 80-character-per-line line printer |

TABLE III

| SYMBOLS USED IN PROGRAM | |
|---|---|
| : | Separate line number from statements |
| + | Positive or addition |
| − | Negative or subtraction |
| * | Multiplication |
| / | Division |
| . | Decimal points |
| , | Separates sections of a list or statement |
| ; | End of a statement |
| = | Equal |
| | Not equal |
| ↑ | Exponentiation |
| [ | End of line and store |
| > | Greater than |
| < | Less than |
| <= | Less than or equal to |
| " " | Indicates literal data between quotation marks |
| ( ) | Grouping |
| --- | Used to separate sections printed on the 2-inch paper tape |

TABLE IV

```
0: "RADIATION ANGLE";"2/27/76" [
1: ENT "DATE CODE",R94;ENT "DISTANCE",X;180*X TO B [
2: ENT "A RATIO",Y;360*X*Y TO A:ENT "C RATIO",Z;0 TO
   R95 [
3: 2*B*Z TO C;0 TO R10 TO R11;ENT "PHASE INCRE-
   MENT",R0 [
4: 0 TO R79;ENT "MODE",R83 [
5: IF R83>2;ENT "ROLL LIMIT",R75 [
6: IF R83>2;ENT "PITCH LIMIT",R86 [
7: PRT "RADIATION ANGLE";FXD 0;PRT R94;SPC ;FXD 4 [
8: PRT "DISTANCE";PRT X;SPC ;PRT "PHASE INCREMENT" [
9: PRT R0;SPC ;PRT "A RATIO";PRT Y;SPC [
10: PRT "C RATIO";PRT Z;SPC [
11: FXD 0;PRT "MODE";PRT R83;SPC 2 [
12: SQR (B↑2+C↑2) TO R7;C/R7 TO R8;B/R7 TO R9 [
13: ATN (B/C) TO R60 [
14: IF R83>2;PRT "ROLL LIMIT";PRT R75;SPC [
15: IF R83>2;PRT "PITCH LIMIT";PRT R86;SPC 2 [
16: FXD 0;ENT "ROLL ANGLE",R10;ENT "PITCH
    ANGLE",R11 [
17: IF R83>2;PRT "ROLL ANGLE";PRT R10;SPC [
18: IF R83>2;PRT "PITCH ANGLE";PRT R11; SPC 2 [
19: ENT "R1",R1;PRT R1;R1 TO R51;−R0*R1 TO R1 [
20: ENT "R2",R2;PRT R2;R2 TO R52;−R0*R2 TO R2 [
21: ENT "R3",R3;PRT R3;R3 TO R53;−R0*R3 TO R3 [
22: ENT "R4",R4;PRT R4;R4 TO R54;−R0*R4 TO R4 [
23: ENT "R5",R5;PRT R5;R5 TO R55;−R0*R5 TO R5 [
24: ENT "R6",R6;PRT R6;R6 TO R56;−R0*R6 TO R6; SPC 2 [
25: FXD 3;0 TO R15 TO R34 TO R50;R10 TO R57 To R104;R11 TO
    R58 [
26: SIN R1+SIN R2+SIN R3+SIN R4+SIN R5+SIN R6 TO R12 [
27: COS R1+COS R2+COS R3+COS R4+COS R5+COS R6+1
    TO R13 [
28: IF R13=0;IF R12=0;0 TO R14;GTO +4 [
29: IF R13=0;IF R12>0;90 TO R14;GTO +3 [
30: IF R13=0;IF 0>R12;−90 TO R14;GTO +2 [
31: ATN (R12/R13) TO R14 [
32: R2−R14+C*SIN R10 TO R16;SIN (R8*R16) TO R100 [
33: R3−R14+C*SIN R10 TO R17;SIN (R8*R17) TO R101 [
34: R5−R14−C*SIN R10 TO R18;SIN (R8*R18) TO R102 [
35: R6−R14−C*SIN R10 TO R19;SIN (R8*R19) TO R103 [
36: R100+R101−R102−R103 TO R20 [
37: COS (−R14)+COS (R1−R14)+COS (R4−R14) TO R21 [
38: COS R16+COS R17+COS R18+COS R19+R21 TO R21 [
39: IF R83>1;GTO 48 [
40: IF R21=0;90 TO R10;IF 0>R20;−90 TO R10 [
41: IF R21=0;R10 TO R36;GTO +6 [
42: ATN (R20/R21) to R22 [
43: IF ABS R22>ABS (.1*R10);R10−.5*R22 TO R10;GTO +2 [
44: R10−R22 TO R10 [
45: IF −90>R10;−90 TO R10;GTO +3 [
46: IF R10>90;90 TO R10;GTO +2 [
47: R15+1 TO R15; IF R15 <= 5;GTO −15 [
48: IF R83 <= 2;PRT "ROLL ANGLE";PRT R10;0 TO R15; SPC [
49: R1−R14+A*SIN R11 TO R23 [
50: R2−R14+B*SIN R11 TO R24 [
51: R3−R14+B*SIN R11 TO R25 [
52: R4−R14+A*SIN R11 TO R26 [
53: R5−R14+B*SIN R11 TO R27 [
54: R6−R14+B*SIN R11 TO R28 [
55: SIN R23+SIN (R9*R24)−SIN (R9*R25) TO R29 [
56: R29−SIN R26−SIN (R9*R27)+SIN (R9*R28) TO R29 [
57: COS (−R14)+COS R23+COS R24+COS R25 TO R30 [
58: COS R26+COS R27+COS R28+R30 TO R30 [
59: IF R83>1;GTO 68 [
60: IF R30=0;90 TO R11;IF 0>R29;−90 TO R11 [
61: IF R30=0;R11 TO R36;GTO +6 [
62: ATN (R29/R30) TO R31 [
63: IF ABS R31>ABS (.1*R11);R11−.5*R31 TO R11;GTO +2 [
64: R11−R31 TO R11 [
65: IF −90>R11;−90 TO R11;GTO +3 [
66: IF R11>90;90 TO R11;GTO +2 [
67: R15+1 TO R 15; IF R15 <= 5;GTO −18 [
68: IF R83 <= 2;PRT "PITCH ANGLE";PRT R11;0 TO R15;SPC [
69: IF ABS R10 <= 1E−5;0 TO R10 [
70: IF ABS R11 <= 1E−5;0 TO R11 [
71: IF R10=0;IF R11=0;GTO +6 [
72: IF R11=0;IF R10 # 0;GTO +9 [
73: IF R10=0;IF R11 # 0;GTO +20 [
74: IF R10 # 0;IF R11 # 0;R34+1 TO R34;IF R83>1;GTO 107 [
75: IF R34 <= 1;SPC ;PRT "DATA REPEATED";SPC ;GTO 32 [
76: IF R10 # 0;IF R11 # 0;0 TO R34;GTO +31 [
77: SQR (R12↑2+R13↑2) TO R32;20*LOG (7/R32) to R32 [
78: 0 TO R61;R14 TO R95;IF R83>2;GTO 179 [
79: PRT "PHASE ANGLE";PRT R95;SPC ;PRT "BORSITE" [
80: PRT "LOSS DB";PRT R32;SPC 2;GTO 179 [
81: C*SIN R10 TO R93;SIN R1+SIN R4+SIN (R2+R93) TO R98 [
82: R98+SIN (R3+R93)+SIN (R5−R93)+SIN (R6−R93) TO R98 [
83: 1+COS R1+COS (R2+R93)+COS (R3+93) TO R99 [
84: R99+COS R4+COS (R5−R93) + (R6−R93) TO R99 [
85: SQR (R98↑2+R99↑2) TO R76;ATN (R98/R99) TO R95 [
86: 20*LOG (7/R76) TO R33;1 TO R61;IF R83>2;GTO 179 [
87: PRT "PHASE ANGLE";PRT R95;SPC ;IF R83=2;GTO +2 [
88: R21 TO R76;IF 0>R21;−R21 TO R76;PRT "SIGNAL IN-
    VERTED" [
```

TABLE IV-continued

```
89: PRT "ROLL LOSS DB";20*LOG (7/R76) to R33;PRT R33 [
90: SPC ;R34+1 TO R34;IF R83=2;GTO 179 [
91: IF R34 <= 1;SPC ;PRT "DATA REPEATED";SPC ;GTO 32 [
92: SPC ;PRT "----------";SPC ;GTO 179 [
93: SIN (R1+A*SIN R11)+SIN (R2+B*SIN R11) TO R98 [
94: R98+SIN (R3−B*SIN R11)+SIN (R4−A*SIN R11) TO R98 [
95: R98+SIN (R5−B*SIN R11)+SIN (R6+B*SIN R11) TO R98 [
96: 1+COS (R1+A*SIN R11)+COS (R2+B*SIN R11) TO R99 [
97: R99+COS (R3−B*SIN R11)+COS (R4−A*SIN R11) TO R99 [
98: R99+COS (R5−B*SIN R11)+COS (R6−B*SIN R11) TO R99 [
99: SQR (R98↑2+R99↑2) TO R77;ATN (R98/R99) TO R95;2 TO
    R61 [
100: 20*LOG (7/R77) TO R35;IF R83>2;GTO 179 [
101: PRT "PHASE ANGLE"; PRT R95;SPC ;IF R83=2;GTO +2 [
102: R30 TO R77;IF 0>R30;−R30 TO R77;PRT "SIGNAL IN-
     VERTED" [
103: PRT "PITCH LOSS DB";20*LOG (7/R77) TO R35;PRT R35 [
104: SPC ;R34+1 TO R34;IF R83=2;GTO 179 [
105: IF R34 <= 1;SPC ;PRT "DATA REPEATED";SPC ;GTO 32 [
106: SPC ;PRT "----------";SPC ;GTO 179 [
107: IF R83 <= 2;SPC ;PRT "----------";SPC 2 [
108: ATN (TAN R57/TAN R58) TO R35;IF R58>0;GTO +3 [
109: IF R57>0;180+R36 TO R36;GTO +2 [
110: R36−180 TO R36 [
111: IF (ABS R57 # 90) (ABS R58 # 90)=0;70 TO R37;GTO +2 [
112: ABS ATN SQR (TAN R57↑2+TAN R58↑2) TO R37 [
113: −A*SIN R36 TO R38 [
114: C*COS R36−B*SIN R36 TO R39 [
115: C*COS R36+B*SIN R36 TO R40 [
116: A*COS R36 TO R62 [
117: C*SIN R36+B*COS R36 TO R63 [
118: C*SIN R36−B*COS R36 TO R64 [
119: COS R37 TO R80;SIN R37 TO R81;SIN R36 TO R82 [
120: SIN (R36−90+R60) TO R96;SIN (R36−90−R60) TO R97 [
121: (R1−R14+R62*R81)*R82 TO R41 [
122: (R2−R14+R63*R81)*R96 TO R42 [
123: (R3−R14+R64*R81)*R97 TO R43 [
124: (R4−R14−R62*R81)*−R82 TO R44 [
125: (R5−R14−R63*R81)*−R96 TO R45 [
126: (R6−R14−R64*R81)*−R97 TO R46 [
127: SIN R41+SIN R42+SIN R43 TO R47 [
128: R47+SIN R44+SIN R45+SIN R46 TO R47 [
129: COS (−R14)+COS R41+COS R42+COS R43 TO R48 [
130: R48+COS R44+COS R45+COS R46 TO R48 [
131: IF R83>1;GTO 137 [
132: ATN (R47/R48) to R50 [
133: IF ABS R50>1;R36+.25*R50 TO R36;GTO +2 [
134: R36+R50 TO R36 [
135: R15+1 TO R15;IF R15 <= 2;GTO 113 [
136: O to R15 [
137: R1−R14+R62*SIN R37 TO R87;R87*COS R36 TO R65 [
138: R2−R14+R63*SIN R37 TO R88;R88*COS (R36−90+R60) TO
     R66 [
139: R3−R14+R64*SIN R37 TO R89;R89*COS (R36−90−R60) TO
     R67 [
140: R4−R14−R62*SIN R37 TO R90;R90*COS (R36−180) TO
     R68 [
141: R5−R14−R63*SIN R37 TO R91;R91*COS (R36+90+R60) TO
     R69 [
142: R6−R14−R64*SIN R37 TO R92;R92*COS (R36+90−R60) TO
     R70 [
143: SIN R65+SIN R66+SIN R67 TO R71 [
144: R71+SIN R68+SIN R69+SIN R70 TO R71 [
145: COS (−R14)+COS R65+COS R66+COS R67 TO R72 [
146: R72+COS R68+COS R69+COS R70 TO R72 [
147: IF R83>1;GTO 157 [
148: IF R72=0;90 TO R37;IF 0>R71;−90 TO R37 [
149: IF R72=0;GTO +4 [
150: ATN (R71/R72) TO R73 [
151: IF ABS R73>ABS (.1*R37);R37−.5*R73 TO R37;GTO +2 [
152: R37−R73 TO R37 [
153: IF R37>90;90 TO R37;GTO +3 [
154: IF −90>37;−90 TO R37;GTO +2 [
155: R15+1 TO R15;IF R15 <= 2;GTO −18 [
156: 0 TO R15;R34+1 TO R34;IF R34 <= 1;GTO 113 [
157: IF R83 <= 2;SPC ;PRT "AZIMUTH ANGLE";PRT R36;SPC [
158: IF R83 <= 2;SPC ;PRT "DEVIATION ANGLE";PRT
     R37;SPC [
159: TAN R37*SIN R36 TO R59;ATN R59 TO R84 [
160: IF R83 <= 2;PRT "ROLL ANGLE";PRT R84;SPC [
161: TAN R37*COS R36 TO R49;ATN R49 TO R85 [
162: IF R83 <= 2;PRT ;PRT "PITCH ANGLE";PRT R85;SPC [
163: COS (−R14)+COS R87+COS R88+COS R89 TO R93 [
164: R93+COS R90+COS R91+COS R92 TO R93;IF R83>1;GTO +
     2 [
165: R93 TO R78;IF 0>R93;−93 TO R78;PRT "SIGNAL INVERT-
     ED" [
166: SIN (R1+R62*SIN R37)+SIN (R2+R63*SIN R37) TO R98 [
167: SIN (R3+R64*SIN R37)+SIN (R4−R62*SIN R37) TO R100 [
168: SIN (R5−R63*SIN R37)+SIN (R6−R64*SIN R37) TO R1-101 [
169: 1+COS (R1+R62*SIN R37)+COS (R2+R63*SIN R37) TO
     R99 [
170: COS (R3+R64*SIN R37)+COS (R4−R62*SIN R37) to R102 [
171: COS (R5+R63*SIN R37)+COS (R6−R64*SIN R37) to R103 [
172: R98+R100+R101 TO R98;R99+R102+P103 TO R99 [
```

TABLE IV-continued

```
173: ATN (R98/R99) TO R95;IF R83 # 1; SQR (98 ↑ 2+R99 ↑ 2) TO
     R78 [
174: 20*LOG (7/R78) TO R74;3 TO R61;IF R83>2;GTO 179 [
175: PRT "PHASE ANGLE"; PRT R95;SPC [
176: PRT "LOSS DB";PRT R74;SPC ;IF R83=2;GTO 179 [
177: SPC ;IF R34=2;PRT "DATA REPEATED";SPC ;GTO 113 [
178: SPC ;PRT "----------";SPC [
179: IF R79=1;GTO +26 [
180: GSB "SUB1" [
181: GSB "SUB2" [
182: GTO +23 [
183: "SUB1" [
184: FMT 1,5/,23X,"PHASED ARRAY BEAM ANGLE AND
     LOSS" [
185: FMT 2,3/,15X,"DATE", FXD 7.0 [
186: FMT 3,/,15X,"DISTANCE", FXD 7.4 [
187: FMT 4,/,15X,"PHASE INCREMENTS",FXD 6.2 [
188: WRT 8.1;WRT 8.2,R94;WRT 8.3.X;WRT 8.4,R0 [
189: FMT 5,/,15X,"A RATIO",FXD 6.3 [
190: FMT 6,/,15X,"C RATIO",FXD 6.3 [
191: FMT 7,/,15X,"STEERING ANGLE AND LOSS" [
192: FMT 8,/,15X,"LOSS AT SPECIFIED ANGLE" [
193: FMT 9,/,15X,"ELEMENT PATTERN INCLUDED" [
194: WRT 8.5,Y;WRT 8.6,Z [
195: IF R83=1;WRT 8.7;RET [
196: WRT 8.8;WRT 8.9;RET [
197: "SUB2" [
198: FMT 1,2/,9X,"PHASE",10X,"ROLL",6X,"PITCH",Z [
199: FMT 2,4X,"AZIMUTH",2X,"DEVIATION",Z [
```

TABLE IV-continued

```
200: FMT 3,3X,"LOSS",5X,"PHASE" [
201: FMT 4,/,9X,"CODE",11X,"ANGLE",5X,"ANGLE",Z [
202: FMT 5,5X,"ANGLE",5X,"ANGLE",6X,"DB",6X,"ANGLE" [
203: WRT 8.1;WRT 8.2;WRT 8.3 [
204: WRT 8.4;WRT 8.5;WRT 8.0;;RET [
205: IF R61 <= 2;R10 TO R84;R11 TO R85;0 TO R50 [
206: IF R61=0;0 TO R36 TO R37;R32 TO R74;GTO +9 [
207: IF R61=;1;ABS R84 TO R37;R33 TO R74;GTO +4 [
208: IF R61=2;GTO +5 [
209: IF R61=3;IF 0>COS R36;180−R85 TO R85 [
210: GTO +5 [
211: 90 TO R36;IF 0>R84;−90 TO R36 [
212: GTO +3 [
213: IF R61=2;R35 TO R74;ABS R85 TO R37 [
214: 0 to R36; IF 0>R84;180 TO R36 [
215: IF R83=4;20*LOG COS R37+R74 TO R74 [
216: FMT 6,/,6FXD 3.0,Z [
217: WRT 8.6,R51,R52,R53,R54,R55,R56 [
218: FMT 7,FXD 11.3,3FXD 10.3,FXD 9.3,FXD 10.3 [
219: WRT 8.7,R84,R85,R36,R37,R74,R95 [
220: 0 to R34;1 TO R79;IF R83 <= 2;R84 TO R10;R85 TO R11;GTO
     7 [
221: IF R10=−3;0 TO R79 [
222: IF R10>R75;0 TO R79;R104 TO R10 TO R57;GTO +2 [
223: R10+3 TO R10 TO R57;GTO 32 [
224: If R11>R86;GTO 7 [
225: R11+3 To R11 TO R58;GTO 32 [
226: END [
```

TABLE V

PHASE ARRAY BEAM ANGLE AND LOSS

DATE 80276
DISTANCE .5100
PHASE INCREMENTS 43.00
A RATIO 1.000
C RATIO 1.250
STEERING ANGLE AND LOSS

| PHASE CODE | ROLL ANGLE | PITCH ANGLE | AZIMUTH ANGLE | DEVIATION ANGLE | LOSS OB | PHASE ANGLE |
|---|---|---|---|---|---|---|
| 0 0 0 0 0 | 0.000 | 0.000 | 0.000 | 0.000 | 0.000 | 0.000 |
| 1 1 0 −1 −1 | 10.710 | 0.000 | 90.000 | 10.710 | .000 | .000 |
| 2 2 0 −2 −2 | 21.639 | 0.000 | 90.000 | 21.639 | .002 | 0.000 |
| 3 3 0 −3 −3 | 34.222 | 0.000 | 90.000 | 34.222 | .000 | 0.000 |
| 4 4 0 −4 −4 | 48.543 | 0.000 | 90.000 | 48.543 | .000 | 0.000 |
| 0 0 −1 0 0 | 0.000 | 9.819 | 0.000 | 9.819 | .239 | 0.000 |
| 1 −1 −1 −1 1 | 0.000 | 17.030 | 9.000 | 17.330 | .239 | 0.000 |
| 1 −1 −2 −1 1 | 0.000 | 27.931 | 0.000 | 27.931 | 0.000 | 0.000 |
| 1 −1 −3 −1 1 | 0.000 | 39.713 | 0.000 | 39.713 | .239 | 0.000 |
| 2 −2 −3 −2 2 | 0.000 | 50.021 | 0.000 | 50.021 | .239 | 0.000 |
| 2 −2 −4 −2 2 | 0.000 | 69.504 | 0.000 | 69.504 | .000 | 0.000 |
| 3 1 −2 −3 −1 | 25.096 | 30.346 | 38.660 | 36.860 | .000 | 0.000 |
| 4 3 −1 −4 −3 | 42.418 | 18.072 | 70.347 | 44.134 | .000 | 0.000 |
| 4 1 −3 −4 −1 | 41.164 | 52.678 | 33.688 | 57.609 | .000 | 0.000 |

TABLE VI

PHASE ARRAY BEAM ANGLE AND LOSS

DATE 80276
DISTANCE .5500
PHASE INCREMENT 47.00
A RATIO 1.000
C RATIO 1.250
STEERING ANGLE AND LOSS

| PHASE CODE | ROLL ANGLE | PITCH ANGLE | AZIMUTH ANGLE | DEVIATION ANGLE | LOSS DB | PHASE ANGLE |
|---|---|---|---|---|---|---|
| 0 0 0 0 0 0 | 0.000 | 0.000 | 0.000 | 0.000 | 0.000 | 0.000 |
| 0 1 1 0 −1 −1 | 10.726 | 0.000 | 90.000 | 10.726 | .000 | 0.000 |
| 0 2 2 0 −2 −2 | 22.059 | 0.000 | 90.000 | 22.059 | .001 | 0.000 |
| 0 3 3 0 −3 −3 | 34.602 | 0.000 | 90.000 | 34.602 | .000 | .000 |
| 0 4 4 0 −4 −4 | 49.429 | 0.000 | 90.000 | 49.429 | .000 | 0.000 |
| 1 0 0 −1 0 0 | 0.000 | 9.950 | 0.000 | 9.950 | .286 | 0.000 |
| 1 1 −1 −1 −1 1 | 0.000 | 17.575 | 0.000 | 17.575 | .286 | 0.000 |
| 2 1 −1 −2 −1 1 | 0.000 | 28.343 | 0.000 | 20.343 | 0.000 | 0.000 |
| 3 1 −1 −3 −1 1 | 0.000 | 40.357 | 0.000 | 40.357 | .286 | 0.000 |
| 3 2 −2 −3 −2 2 | 0.000 | 50.959 | 0.000 | 50.959 | .286 | 0.000 |
| 4 2 −2 −4 −2 2 | 0.000 | 71.687 | 0.000 | 71.687 | .000 | 0.000 |
| 2 3 1 −2 −3 −1 | 25.565 | 30.877 | 38.660 | 37.443 | .000 | 0.000 |
| 1 4 3 −1 −4 −3 | 43.176 | 18.522 | 70.350 | 44.894 | .000 | 0.000 |
| 3 4 1 −3 −4 −1 | 42.565 | 54.009 | 33.705 | 58.859 | .000 | 0.000 |

TABLE VII

PHASED ARRAY BEAM ANGLE AND LOSS

DATE 80276
DISTANCE .5500
PHASE INCREMENTS 31.33
A RATIO 1.000
C RATIO 1.250
STEERING ANGLE AND LOSS

| PHASE CODE | ROLL ANGLE | PITCH ANGLE | AZIMUTH ANGLE | DEVIATION ANGLE | LOSS DB | PHASE ANGLE |
|---|---|---|---|---|---|---|
| 0 0 0 0 0 0 | 0.000 | 0.000 | 0.000 | 0.000 | 0.000 | 0.000 |
| 0 1 1 0 −1 −1 | 7.083 | 0.000 | 90.000 | 7.083 | .000 | 0.000 |
| 0 2 2 0 −2 −2 | 13.855 | 0.000 | 90.000 | 13.855 | .006 | .000 |
| 0 3 3 0 −3 −3 | 22.141 | 0.000 | 90.000 | 22.141 | .000 | 0.000 |
| 0 4 4 0 −4 −4 | 30.158 | 0.000 | 90.000 | 30.158 | .001 | 0.000 |
| 0 5 5 0 −5 −5 | 39.296 | 0.000 | 90.000 | 39.296 | .000 | 0.000 |
| 0 6 6 0 −6 −6 | 49.429 | 0.000 | 90.000 | 49.429 | .000 | 0.000 |
| 1 0 0 −1 0 0 | 0.000 | 6.621 | 0.000 | 6.621 | .126 | 0.000 |
| 1 1 −1 −1 −1 1 | 0.000 | 11.607 | 0.000 | 11.607 | .126 | 0.000 |
| 2 1 −1 −2 −1 1 | 0.000 | 18.451 | 0.000 | 18.451 | 0.000 | 0.000 |
| 3 1 −1 −3 −1 1 | 0.000 | 25.582 | 0.000 | 25.582 | .126 | 0.000 |
| 3 2 −2 −3 −2 2 | 0.000 | 31.177 | 0.000 | 31.177 | .126 | 0.000 |
| 4 2 −2 −4 −2 2 | 0.000 | 39.272 | 0.000 | 39.272 | 0.000 | 0.000 |
| 5 2 −2 −5 −2 2 | 0.000 | 48.444 | 0.000 | 48.444 | .126 | 0.000 |
| 5 3 −3 −5 −3 3 | 0.000 | 56.531 | 0.000 | 56.531 | .126 | 0.000 |
| 6 3 −3 −6 −3 3 | 0.000 | 71.697 | 0.000 | 71.697 | .000 | 0.000 |

TABLE VIII

PHASED ARRAY BEAM ANGLE AND LOSS

DATE 80276
DISTANCE .5500
PHASE INCREMENTS 31.33
A RATIO 1.000
C RATIO 1.250
STEERING ANGLE AND LOSS

| PHASE CODE | ROLL ANGLE | PITCH ANGLE | AZIMUTH ANGLE | DEVIATION ANGLE | LOSS DB | PHASE ANGLE |
|---|---|---|---|---|---|---|
| 1 6 6 −1 −6 −6 | 49.885 | 10.215 | 81.367 | 50.206 | .126 | 0.000 |
| 2 6 5 −2 −6 −5 | 46.396 | 22.407 | 68.561 | 48.442 | .126 | 0.000 |
| 3 6 4 −3 −6 −4 | 44.577 | 33.236 | 56.376 | 49.800 | .125 | 0.000 |
| 4 6 4 −4 −6 −4 | 49.414 | 45.141 | 49.274 | 57.007 | .516 | 0.000 |
| 4 6 3 −4 −6 −3 | 44.847 | 45.916 | 43.931 | 55.104 | .126 | 0.000 |
| 5 6 2 −5 −6 −2 | 50.132 | 60.268 | 34.366 | 64.759 | .128 | 0.000 |
| 6 6 1 −6 −6 −1 | 83.441 | 86.717 | 26.515 | 87.062 | .127 | 0.000 |
| 5 6 1 −5 −6 −1 | 45.986 | 61.865 | 28.962 | 64.927 | .001 | 0.000 |
| 5 5 0 −5 −5 0 | 30.901 | 56.489 | 21.619 | 58.384 | .000 | .000 |
| 5 5 1 −5 −5 −1 | 35.181 | 54.048 | 27.079 | 57.147 | .128 | 0.000 |
| 6 5 1 −6 −5 −1 | 49.199 | 69.082 | 23.883 | 70.736 | .514 | 0.000 |
| 6 4 0 −6 −4 0 | 29.520 | 63.160 | 15.988 | 64.060 | .511 | 0.000 |
| 5 4 −1 −5 −4 1 | 18.066 | 53.696 | 13.477 | 54.456 | .000 | .000 |
| 6 4 −1 −6 −4 1 | 27.564 | 67.481 | 12.211 | 67.941 | .128 | 0.000 |
| 6 3 −2 −6 −3 2 | 9.206 | 65.310 | 4.261 | 65.370 | .127 | 0.000 |
| 6 5 0 −6 −5 0 | 47.593 | 72.714 | 18.815 | 73.587 | .127 | 0.000 |
| 6 4 −2 −6 −4 2 | 25.119 | 73.230 | 8.042 | 73.385 | .002 | 0.000 |
| 6 5 −1 −6 −5 1 | 53.758 | 78.689 | 15.263 | 79.078 | .001 | 0.000 |

The foregoing disclosure and description of the invention are illustrative and explanatory thereof and various changes in the size, shape, materials, components, circuit elements, wiring connections and contacts, as well as in the details of the illustrated circuitry and construction may be made without departing from the spirit of the invention.

I claim:

1. In a phased-angle antenna having a relatively small number of elements for radiating signals at one frequency and receiving signals at another frequency, an improvement for effective operation of the antenna at both frequencies comprising said antenna elements being arranged in a two-dimensional planar matrix of elements spaced in first and second directions with respect to a center point of the array and having the spacing in one of said directions a distance of approximately one-half wavelength of the average of said frequencies and in the other of said directions by a distance equalling the product of one and a fraction times the distance in said one of said directions, and a four bit digital control circuit for changing the phase angle of the elements wherein a phase angle increment of $\pi/6$ radians and proportional to the radiating frequency and the receiving frequency is available for steering the antenna, said control circuit including least significant digital control means to control the phase angle in one phase angle increment, next significant digital control means to control the phase angle in two phase angle increments, next most significant digital control means to control the phase angle in four phase angle increments, and most significant digital control means to control the phase angle in seven phase angle increments.

2. In a phased-angle antenna having a relatively small number of elements for radiating signals at one frequency and receiving signals at another frequency, an improvement for effective operation of the antenna at both frequencies comprising said antenna elements being arranged in a two-dimensional planar matrix of elements spaced in first and second directions with respect to a center point of the array and having the spacing in one of said directions a distance of approximately one-half wavelength of the average of said frequencies and in the other of said directions by a distance equalling the product of one and a fraction times the distance in said one of said directions, and a digital control circuit means for changing the phase angle of the element wherein a phase angle increment of $\pi/6$ radians and proportional to the radiating frequency and the receiving frequency is available for steering the antenna.

* * * * *